US008739481B2

(12) United States Patent
Kim

(10) Patent No.: US 8,739,481 B2
(45) Date of Patent: Jun. 3, 2014

(54) HIDDEN RAIL TYPE WINDOW AND DOOR SYSTEM

(76) Inventor: Soon Seok Kim, Gyeonggi-do (KR)

( * ) Notice: Subject to any disclaimer, the term of this patent is extended or adjusted under 35 U.S.C. 154(b) by 0 days.

(21) Appl. No.: 13/983,060

(22) PCT Filed: Aug. 24, 2011

(86) PCT No.: PCT/KR2011/006252
§ 371 (c)(1),
(2), (4) Date: Aug. 1, 2013

(87) PCT Pub. No.: WO2012/124865
PCT Pub. Date: Sep. 20, 2012

(65) Prior Publication Data

US 2013/0340363 A1 Dec. 26, 2013

(30) Foreign Application Priority Data

Mar. 17, 2011 (KR) ..... 10-2011-0023911

(51) Int. Cl.
*E06B 3/68* (2006.01)
*E06B 9/01* (2006.01)

(52) U.S. Cl.
USPC ..... 52/204.6; 52/209; 52/656.7

(58) Field of Classification Search
USPC ..... 52/204.51, 207, 209, 204.6, 656.4, 52/656.5, 656.7, 788.1, 204.7
See application file for complete search history.

(56) References Cited

U.S. PATENT DOCUMENTS

| | | | | |
|---|---|---|---|---|
| 4,967,507 | A * | 11/1990 | Visnic et al. | 49/504 |
| 7,520,093 | B2 * | 4/2009 | Guhl | 52/204.1 |
| 2005/0166494 | A1 * | 8/2005 | Guhl | 52/204.1 |
| 2012/0005975 | A1 * | 1/2012 | Kim | 52/209 |

FOREIGN PATENT DOCUMENTS

| | | |
|---|---|---|
| KR | 10-2009-0022245 | 8/2007 |
| KR | 10-20100-0001473 | 6/2008 |
| KR | 10-0901994 | 6/2009 |
| WO | 01/33024 | 5/2001 |

* cited by examiner

*Primary Examiner* — Brian Glessner
*Assistant Examiner* — Brian D Mattei
(74) *Attorney, Agent, or Firm* — Mark M. Friedman

(57) ABSTRACT

There is provided a window/door system having a hidden rail structure wherein a rail structure is detachably installed at a substructure, the substructure installed where a window/door is to be installed, thereby making it very easy to replace and to maintain/repair the rail. In addition, the rail is hidden so as not to be visible to the outside when a window/door is opened/closed.

That is, the present invention is to provide a window/door system having a hidden rail structure, wherein the rail structure is detachably installed at a substructure positioned where a window/door frame is to be installed, thereby making it very easy to replace and to maintain/repair the rail. Since the window/door system having a hidden rail structure according to the present invention also hides the rail so as not to be visible to the outside when a window/door is opened/closed by a sliding motion and the top of the hidden rail structure is processed so as to be flat, it not only provides a neat appearance but also makes it easy to clean. Furthermore, it has a new structure of improving air tightness against any draft and/or noise by a multileveled shielding structure.

5 Claims, 5 Drawing Sheets

HIDDEN RAIL TYPE WINDOW AND DOOR SYSTEM

TECHNICAL FIELD

The present invention relates to a window/door system having a hidden rail structure, and more particularly, to a window/door system having a hidden rail structure wherein a rail structure is detachably installed at a substructure, the substructure installed where a window/door is to be installed, thereby making it very easy to replace and to maintain/repair the rail. In addition, the rail is hidden so as not to be visible to the outside when a window/door is opened/closed.

DESCRIPTION OF THE RELATED ART

As windows/doors have been required to provide high grades and functionality for buildings, the windows/doors have been developed in various forms for use. For example, lift-sliding type system windows/doors have been developed to be widely used for relatively large windows/doors such as sliding doors in a living room or windows in a balcony. Security windows/doors have been developed to have a security function The windows/doors used in diverse buildings are formed to essentially have window/door frames to be combined with the windows/doors to be open and closed by a sliding motion. These windows/doors are required to meet the weathering resistance which has a high resistance against an outside air, the durability and the high mechanical properties to bear the load of glass.

In the conventional window/door systems, rail grooves are formed in window/door frames, to be combined with windows/doors to be open and closed by a sliding motion. However, when people walk passing the rail grooves, the rail groves cause a feeling of irritation to the feet or act as a dangerous obstruction causing them to stumble. Further, in the window/door frames used in verandas, foreign substances including dust easily collect in the rail grooves and it is difficult to clean and remove the foreign substances from the rail grooves. Specifically, since a draft or rainwater easily comes into through the window/door frames used in the verandas and the rail grooves thereof, air tightness and drainage are greatly reduced.

To solve the above-indicated drawbacks, windows/doors having a hidden rail structure that does not expose rail grooves and improves air tightness and drainage have been launched. However, since structures combining a window/door with a rail groove of a window/door frame are complicated, it is very difficult to separate the window/door from the rail groove. In addition, since is no structure to drain rainwater is separately provided, drainage is not good. Moreover, since the structure to block a draft is simple, it fails to thoroughly block the draft from passing through.

Specifically, the biggest drawback of the conventional windows/doors having a hidden rail structure is that it is impossible to replace and to maintain/repair the rail.

Namely, in the constitution of the conventional windows/doors having a hidden rail structure, the rail structure is formed in a single body with the top of a substructure installed where a window/door frame is to be installed. Therefore, when a defect happens in the sliding opening/closing motion of a window/door since the rail of the rail structure brakes or is damaged, it is impossible to separate the rail structure, making it impossible to replace the rail structure having the rail and/or to easily maintain/repair it. Eventually, since the whole substructure needs to be removed, the scale of repair work becomes very costly.

DETAILED DESCRIPTION OF THE INVENTION

Technical Problem

Therefore, it is an object of the present invention to solve the above problems of the conventional windows/doors having a hidden rail structure and to provide a window/door system having a hidden rail structure, wherein the rail structure is detachably installed at a substructure positioned where a window/door frame is to be installed, thereby making it very easy to replace and to maintain/repair the rail. Since the window/door system having a hidden rail structure according to the present invention also hides the rail so as not to be visible to the outside when a window/door is opened/closed by a sliding motion and the top of the hidden rail structure is processed so as to be flat, it not only provides a neat appearance but also makes it easy to clean. Furthermore, it has a new structure of improving air tightness against any draft and/or noise by a multileveled shielding structure.

Technical Solution

In accordance with an embodiment of the present invention, there is provided a window/door system having a hidden rail structure, comprising: a substructure to be open at a top and installed in a two or more parallel line arrangement where a window/door frame is to be installed, comprising: a shielding plate installed at a bottom side of the substructure, and rail holding parts formed in a single body with both inside walls of the substructure, above the shielding plate, in a direction of the length of the substructure; a rail structure to be detachably secured on the rail holding parts of the substructure; a rail covering structure having a flat shaped structure, to prevent the detachable rail structure from being exposed or visible to the outside, comprising connection parts formed in a single body with an under side of the rail covering structure, so that the connection parts are connected within a connection element of the detachable rail structure by a one-touch manner; and a window/door driving structure comprising: a top plate to be connected with a chassis frame of a window/door by a fastening structure, an inside plate and an outside plate downwardly extending from the inside and outside ends of the top plate, respectively, an inside roller supporting plate and an outside roller supporting plate respectively inwardly and outwardly extending from the lower ends of the inside plate and outside plate, and rollers positioned at bottoms of the inside and outside roller supporting plates and secured to roll along rails of the rail structure.

The detachable rail structure may comprise: securing parts formed in a single body with the inside and outside ends of the rail structure, so that the securing parts are secured to the rail holding parts of the substructure; a connection element protruding at a central part of the rail structure, so that the connection parts of the rail covering structure are inserted in the connection element; and rails respectively positioned between one of the securing parts and the connection element and between the other of the securing parts and the connection element.

The fastening structure to connect and fasten the chassis frame of the window/door and the window/door driving structure may comprise: a horizontal assembling plate to be assembled at a bottom of the chassis frame of the window/door; and a vertical fastening plate formed in a single body on an under surface of the horizontal assembling plate, to be inserted into an opening formed on the top plate of the window/door driving structure.

In accordance with another embodiment of the present invention, there is provided a window/door system having a hidden rail structure, comprising: a substructure to be open at a top and installed in a two or more parallel line arrangement where a window/door frame is to be installed, comprising: a shielding plate installed at a bottom side of the substructure, and rail holding parts formed in a single body with both inside walls of the substructure, above the shielding plate, in a direction of the length of the substructure; a rail structure to be detachably secured on the rail holding parts of the substructure; a rail covering structure to prevent the detachable rail structure from being exposed or visible to the outside, comprising: a horizontal plate having a sliding hole being lengthwise cut and formed at a central part of the horizontal plate; and a vertical plate formed in a single body at the inside and outside ends of the horizontal plate, to be secured to the detachable rail structure; and a window/door driving structure comprising: a top plate to be connected with a chassis frame of a window/door by a fastening structure, an inside plate and an outside plate downwardly extending from the inside and outside ends of the top plate, respectively, a bottom plate formed in a single body with the lower ends of the inside plate and outside plate, a roller supporting rod in a straight line shape formed in a single body at a central position on an under surface of the bottom plate, and rollers mounted under a roller supporting plate formed in a single body at a lower end of the roller supporting rod, so that the rollers are secured to roll along the rails of the detachable rail structure.

The detachable rail structure may have a flat shaped structure and comprises securing projections protruding on the inside and outside ends of the rail structure, to secure the rail covering structure.

Further, the rail covering structure may comprise securing supporting parts formed in a single body in both lower ends of the vertical plate, to be secured at the securing projections of the detachable rail structure.

Preferably, the rail covering structure may comprise airtight packing units positioned on the rail covering structure and secured to an outside surface of the roller supporting rod.

The fastening structure connecting and fastening the chassis frame of the window/door and the top plate of the window/door driving structure may comprise: press-fitting elements to be press-fit into the top plate of the window/door driving structure, and binding ends formed in a single body at under surfaces of the chassis frame, to be partially inserted into tops of the press-fitting elements.

Advantageous Effects

In accordance with the present invention, when the window/door is installed, the rail structure with a rail is detachably installed. Therefore, when a defect happens in the rail of the rail structure after the window/door is installed or when the rail of the rail structure is damaged by the operation of repetitive sliding to open/close the window/door, it is very easy to replace the rail with a new rail and/or to maintain/repair it by the separate rail structure.

Further, the rails of the rail structure of the window/door frame are covered so as not to be visible to the outside and the rail covering plate which hides the rails has a flat surface, not only the appearance is neat but also foreign substances are prevented from being trapped, thereby easily maintaining a clean appearance.

DESCRIPTION OF THE DRAWINGS

The above and other features and advantages of the present invention will become more apparent to those of ordinary skill in the art by describing in detail preferred embodiments thereof with reference to the attached drawings in which.

[Description of numbers for constituents in drawings]

| | |
|---|---|
| 100: substructure | 102: shielding plate |
| 104: rail holding part | 110: chassis frame |
| 120: binding end | 200: detachable rail structure |
| 202: connection element | 204: securing part |
| 206: rail | 208: securing projection |
| 300: rail covering structure | 302: connection part |
| 304: horizontal plate | 306: sliding hole |
| 308: vertical plate | 310: Securing supporting part |
| 312: airtight packing unit | 400: fastening structure |
| 402: horizontal assembling plate | 404: vertical fastening plate |
| 430: press-fitting element | 500: window/door driving structure |
| 502: top plate | 504: inside plate |
| 506: outside plate | 508: inside roller supporting plate |
| 510: outside roller supporting plate | 512: roller |
| 514: opening | |
| 516: roller supporting rod in a straight line shape | |
| 518: roller supporting plate | 520: bottom plate |

PREFERRED EMBODIMENTS

The present invention focuses on the points that, when a window/door, such as various veranda windows or doors, is opened/closed by a sliding motion, the rail structure of the window/door is hidden not to be exposed or visible to the outside, and as the rail structure is detachably installed to a substructure, it is very easy to replace and maintain/repair.

First Embodiment

Figure 1:
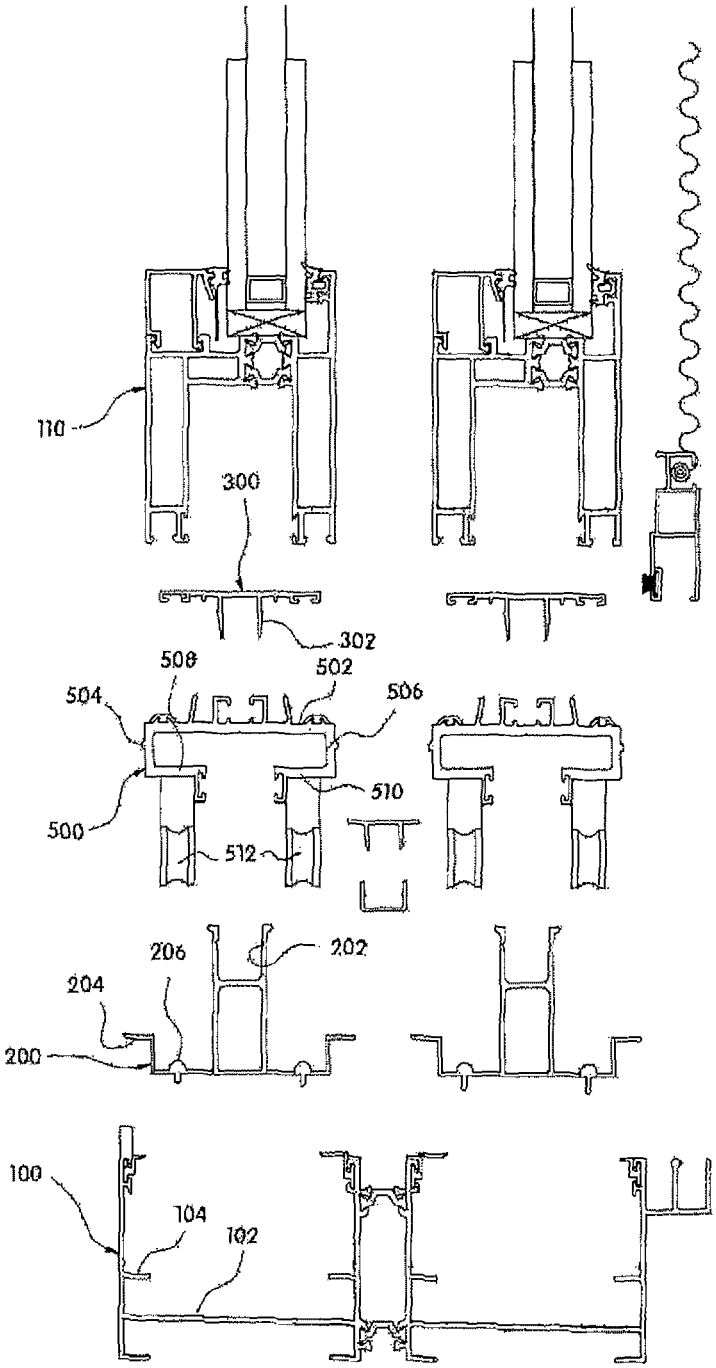
FIG. 1 is a separate cross-sectional view of a window/door system having a hidden rail structure according to a first embodiment of the present invention.
Figure 2:
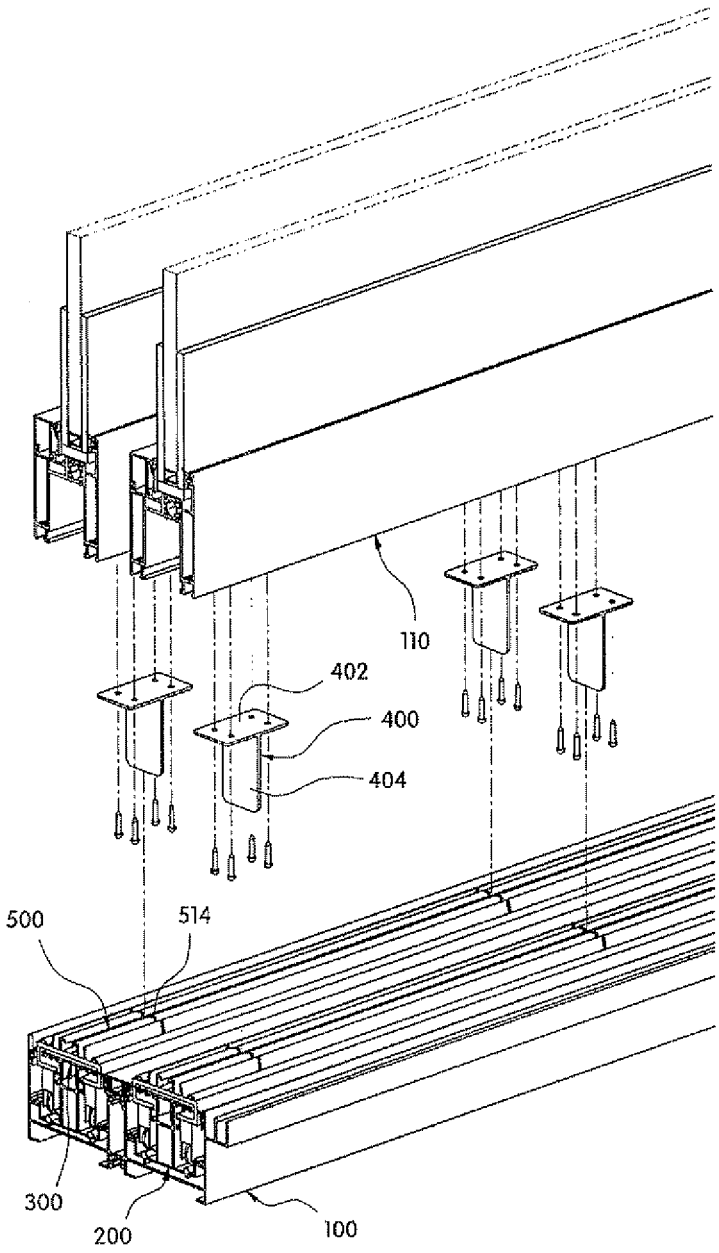
FIG. 2 is a separate perspective view of the window/door system having a hidden rail structure according to the first embodiment.
Figure 3:
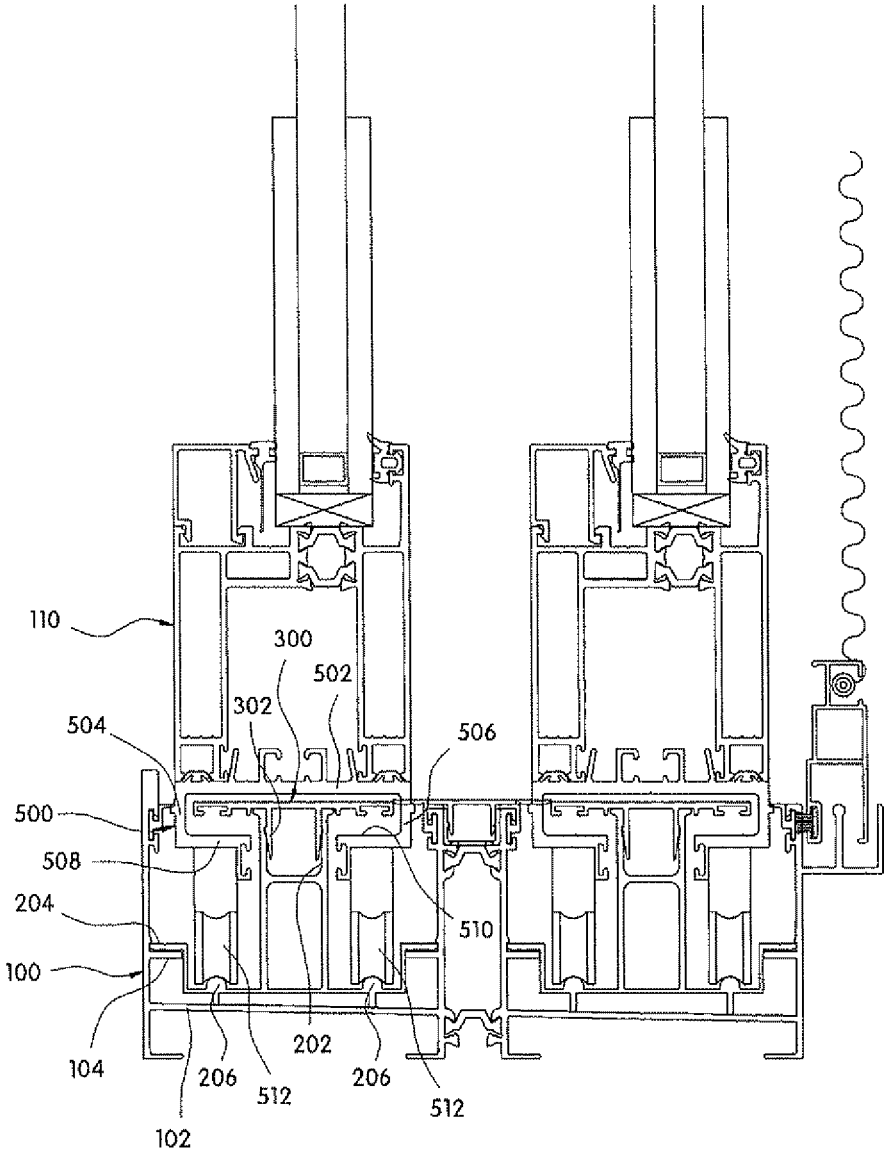
FIG. 3 is an assembled cross-sectional view of the window/door system having a hidden rail structure according to the first embodiment.

The window/door system having a hidden rail structure according to a first embodiment of the present invention will be described with reference with accompanying FIGS. 1 through 3.

A substructure 100 is installed to be fixed at a position where a window/door frame is to be installed, i.e., a concrete surface in a veranda or a window site for a window/door system.

The substructure 100 is open at a top and it is installed in a two or more parallel line arrangement. A shielding plate 102 is formed in a single body on the bottom surface, to primarily block any draft and/or noise transferred from the outside. Rail holding parts 104 are formed in a single body on both inside wall surfaces above the shielding plate 102 in a direction of the length of the substructure 100.

A detachable rail structure 200 according to the first embodiment of the present invention is detachably secured at the rail holding parts 104 of the substructure 100.

More specifically, in order to secure the detachable rail structure 200 at the rail holding part 104, securing parts 204 to be secured to the rail holding parts 104 of the substructure 100 are formed in a single body at the inside and outside ends of the detachable rail structure 200. Further, a connection element 202, into which connection parts 302 of a rail covering structure 300 (to be described below) are inserted, upwardly protrudes at a central part on the detachable rail structure 200. Rails 206 are formed to protrude respectively between one of the securing part 204 and the connection element 202 and between the other of the securing part 204 and the connection element 202.

A window/door driving structure 500 to be connected to a chassis frame 110 of the window/door by a fastening structure 400 is secured to slide along the rails 206 of the rail structure 200.

The window/door driving structure 500 is connected to the chassis frame 110 of the window/door by the fastening structure 400, to make a rolling motion, together with the window/door when opening/closing the window/door by a sliding motion. The window/door driving structure 500 comprises: a top plate 502, an inside plate 504 and an outside plate 506 downwardly extending from inside and outside ends of the top plate 502, and inside and outside roller supporting plates 508, 510 respectively outwardly and inwardly extending from lower ends of the inside plate 504 and outside plate 506.

Rollers 512 are mounted at the bottom of the inside and outside roller supporting plates 508, 510 of the window/door driving structure 500, so that the rollers 512 are secured to roll along the rails 206 of the rail structure 200. Substantially, as the rollers 512 roll along the rails 206, the window/door driving structure 500 and the window/door are opened/closed by a sliding motion.

Specifically, in the window/door driving structure 500, a certain inside space is formed by the top plate 502, the inside plate 504 and outside plate 506 downwardly extending from the inside and outside ends of the top plate 502 and the inside and outside roller supporting plates 508, 510 respectively outwardly and inwardly extending from the lower ends of the inside plate 504 and outside plate 506. The rail covering structure 300 is positioned in this inside space, as see FIG. 3.

More specifically, the rail covering structure 300 has a flat shaped structure to prevent the rails of the detachable rail structure 200 from being exposed or visible to the outside. The connection parts 302 are formed in a single body at an under surface of the rail covering structure 300, so that the connection parts 302 are connected to the connection element 202 of the detachable rail structure 200 by an one-touch manner.

Therefore, in the state that the connection parts 302 of the rail covering structure 300 is connected to be fixed in the connection element 202 of the detachable rail structure 200 by the one-touch manner, the rail covering structure 300 exists in the inside space formed by the top plate 502, the inside plate 504 and outside plate 506 downwardly extending from the inside and outside ends of the top plate 502 and the inside and outside roller supporting plates 508, 510 respectively outwardly and inwardly extending from the lower ends of the inside plate 504 and outside plate 506. The rail covering structure 300 is positioned in this inside space.

The fastening structure 400 connected between the chassis frame 110 of the window/door and the top plate 502 of the window/door driving structure 500 is substantial means enabling the chassis frame 110 of the window/door and the window/door driving structure 500 to opened/closed by the sliding motion. The fastening structure 400 comprises a horizontal assembling plate 402 to be assembled at a bottom of the chassis frame 110 of the window/door, and a vertical fastening plate 404 formed in a single body on an under surface of the horizontal assembling plate 402 and inserted into an opening 514 formed on the top plate 502 of the window/door driving structure 500.

In the state that the window/door system according to the first embodiment of the present invention is assembled in the above-described manner, when a user opens/closes the chassis frame 110 of the window/door in the opening/closing direction, since the chassis frame 110 and the window/door driving structure 500 are connected by the fastening structure 400, in other words, the horizontal assembling plate 402 of the fastening structure 400 is assembled with the chassis frame 110 and simultaneously the vertical fastening plate 404 formed in the single body with the horizontal assembling plate 402 is inserted into the opening 514 formed on the top plate 502 of the window/door driving structure 500, the rollers 512 of the window/door driving structure 500 roll and move along the rails 206 of the detachable rail structure 200 and therefore the chassis frame 110 of the window/door, that is, the window/door, is opened/closed.

Then, as the connection parts 302 of the rail covering structure 300 are connected to and fixed in the connection element 202 of the detachable rail structure 200 by the one-touch manner, the rails 206 formed on the rail structure 200 are covered by the rail covering structure 300. Therefore, when the window/door is opened/closed, since the rails 206 formed on the rail structure 200 are covered by the rail covering structure 300, they are not visible to the outside.

Accordingly, only the flat surface of the rail covering structure 300 formed in the flat surface is exposed or visible to the outside when the window/door is opened/closed by the sliding motion, thereby providing a neat appearance and preventing foreign substance from being trapped, making it easy to clean and making it possible to always keep a clean surface.

Specifically, in accordance with the present invention, since the rail structure 200 is installed to be detached from the substructure 100, when a defect happens in the rails 206, etc. of the rail structure 200 after the window/door is installed or when the rails 206 of the rail structure 200 is damaged or broken by the repetitive sliding opening/closing operations of the window/door, the rails 206 may be very simply replaced with new ones by easily separating the rail structure 200 from the substructure 100. That is, the maintenance/repair is very simply done.

That is, since the securing parts 204 of the detachable rail structure 200 according to the first embodiment of the present invention are held at the rail holding parts 104 of the substructure 100, without any additionally joint means, the detachable rail structure 200 is easily brought out and separated and thus making it very simple to replace and/or maintain/repair the damaged rail structure 200.

Furthermore, the shielding plate 102 positioned at the bottom of the substructure 100 primarily blocks any draft and/or noise, and a portion where the rail holding parts 104 of the substructure 100 and the securing parts 204 of the detachable rail structure 200 are secured secondarily, increasing the efficiency of blocking any draft and/or noise.

Second Embodiment

Figure 4:
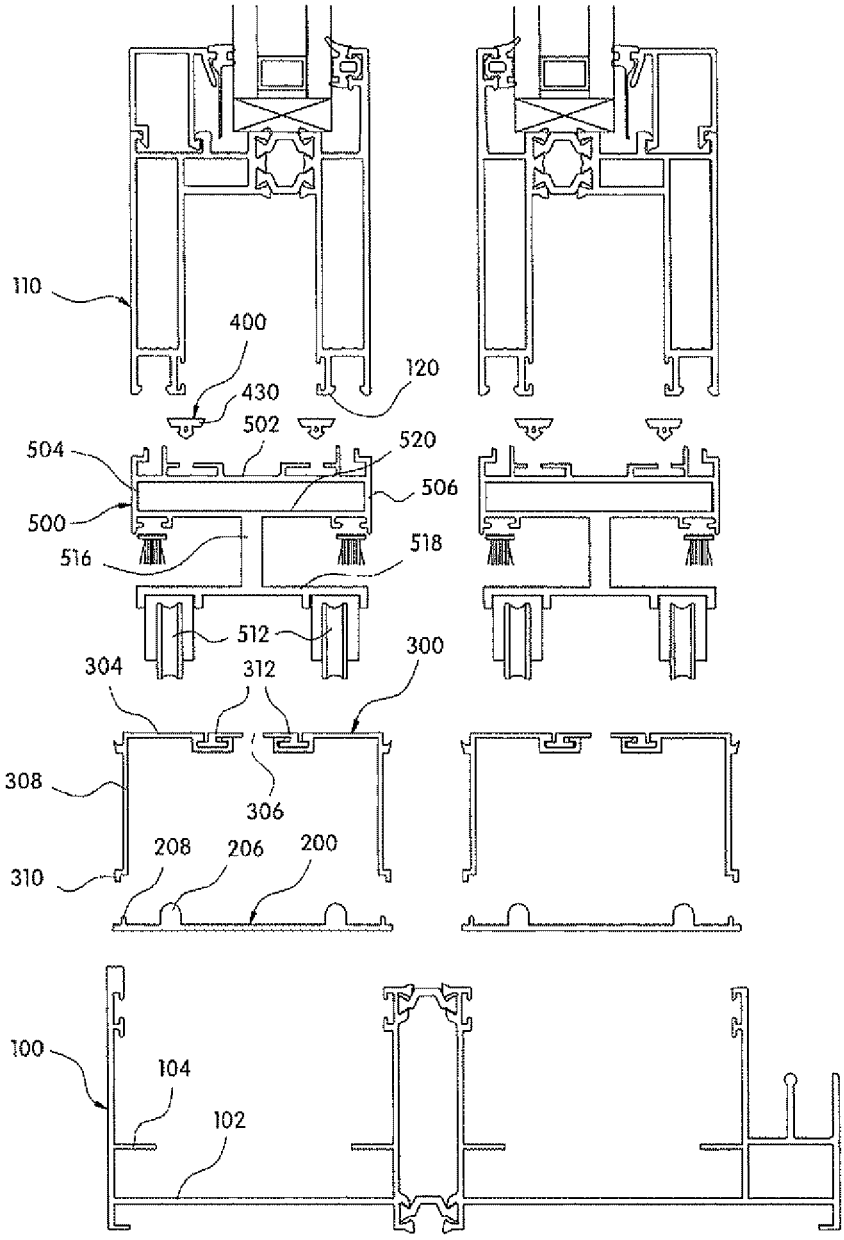
FIG. 4 is a separate cross-sectional view of a window/door system having a hidden rail structure according to a second embodiment of the present invention.
Figure 5:
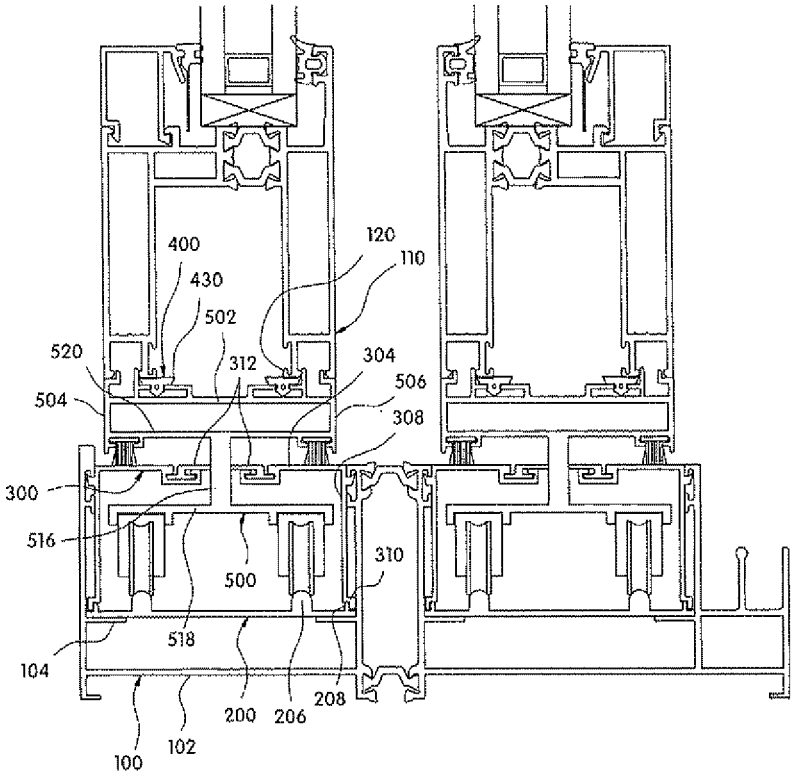
FIG. 5 is an assembled cross-sectional view of the window/door system having a hidden rail structure according to the second embodiment.

A window/door system having a hidden rail structure according to a second embodiment of the present invention will be described with reference with accompanying FIGS. 4 and 5.

Like the first embodiment, a substructure 100 is installed to be fixed at a position where a window/door frame is to be installed, i.e., a concrete surface in a veranda or a window site for a window/door system.

In the same manner, the substructure 100 is open at a top and it is installed in a two or more parallel line arrangement. A shielding plate 102 is formed in a single body on a bottom surface, to primarily block any draft and/or noise transferred from the outside. Rail holding parts 104 are formed in a single body on both inside wall surfaces above the shielding plate 102 in a direction of the length of the substructure 100.

In addition, a detachable rail structure 200 according to the second embodiment of the present invention is detachably secured at the rail holding parts 104 of the substructure 100.

The detachable rail structure 200 according to the second embodiment of the present invention has a flat shaped structure. Securing projections 208 protrude on inside and outside ends of the rail structure 200, to secure a rail covering structure 300.

A window/door driving structure 500 to be connected to a chassis frame 110 of the window/door by a fastening structure 400 is secured to slide or roll along the rails 206 of the rail structure 200.

The window/door driving structure 500 is connected to the chassis frame 110 of the window/door by the fastening structure 400, to make a rolling motion, together with the window/door when opening/closing the window/door by a sliding motion. The window/door driving structure 500 comprises: a top plate 502, an inside plate 504 and an outside plate 506 downwardly extending from inside and outside ends of the top plate 502, a bottom plate 520 formed in a single body with lower ends of the inside plate 504 and outside plate 506, and a roller supporting rod 516 in a straight line shape formed in a single body at a central position on an under surface of the bottom plate 520.

A roller supporting plate 518 being flat is formed in a single body at a lower end of the roller supporting rod 516 in the straight line shape of the window/door driving structure 500. Rollers 512 are mounted under the roller supporting plate 518, so that the rollers 512 are secured to roll along the rails 206 of the attachable rail structure 200. Substantially, as the rollers 512 roll along the rails 206, the window/door driving structure 500 and the window/door are opened/closed by a sliding motion.

Specifically, the rail covering structure 300 is provided so that the lower end of the roller supporting rod 516 and the rollers 512 of the window/door driving structure 500 and the detachable rail structure 200 are not exposed or visible to the outside. The rail covering structure 300 comprises a horizontal plate 304 including a sliding hole 306 lengthwise formed at a central part thereof, and a vertical plate 308 formed in a single body at inside and outside ends of the horizontal plate 304 and secured to the detachable rail structure 200.

Securing supporting parts 310 are formed in a single body in both lower ends of the vertical plate 308 of the rail covering structure 300. Since the securing supporting parts 310 are secured at the securing projections 208 of the detachable rails structure 200, the horizontal plate 304 of the rail covering structure 300 covers the rails 206 of the rail structure 200. Then, the lower end of the roller supporting rod 516 and the rollers 512 of the window/door driving structure 500 are inside the rail covering structure 300, not shown.

Furthermore, airtight packing units 312 (a kind of a rubber gasket) are positioned on the horizontal plate 304 of the rail covering structure 300. The airtight packing units 312 are secured to an outer surface of the roller supporting rod 516 passing through the sliding hole 306.

The fastening structure 400 to connect and fasten the chassis frame 110 of the window/door and the top plate 502 of the window/door driving structure 500 comprises press-fitting elements 430 having elasticity to be press-fit into the top plate 502 of the window/door driving structure 500, and binding ends 120 formed in a single body at under surfaces of the chassis frame 110 and partially inserted into tops of the press-fitting elements 430.

That is, when the lower ends of the press-fitting elements 430 are press-fit to be fixed on the top plate 502 of the window/door driving structure 500, the lower ends of the binding ends 120 formed at the under surfaces of the chassis frame 110 are pressed to be fit into the tops of the press-fitting elements 430, so that the chassis frame 110 of the window/door is mutually fastened with the top plate 502 of the window/door driving structure 500.

In the state that the window/door system according to the second embodiment of the present invention is assembled in the above-described manner, when a user opens/closes the chassis frame 110 of the window/door in the opening/closing direction, since the chassis frame 110 and the window/door driving structure 500 are connected by the fastening structure 400, that is, the press-fitting elements 430, the rollers 512 of the window/door driving structure 500 roll and move along the rails 206 of the detachable rail structure 200 and therefore the chassis frame 110 of the window/door, that is, the window/door, is opened/closed.

Then, when the window/door is opened/closed, the roller supporting rod 516 of the window/door driving structure 500 moves, along the sliding hole 306 formed on the horizontal plate 304 of the rail covering structure 300.

As described above, the horizontal plate 304 of the rail covering structure 300 covers the rails 206 of the rail structure 200 and simultaneously the lower end of the roller supporting rod 516 and the rollers 512 of the window/door driving structure 500 being within the rail covering structure 300 are not shown. Accordingly, only the flat surface of the rail covering structure 300 formed in the flat surface is exposed or visible to the outside when the window/door is opened/closed by the sliding motion, thereby providing a neat appearance and preventing foreign substances from being trapped, making it easy to clean and also making it possible to always keep a clean surface.

Specifically, in accordance with the second embodiment of the present invention, since the rail structure 200 is installed to be detached from the substructure 100, when a defect happens in the rails 206, etc. of the rail structure 200 after the window/door is installed or when the rails 206 of the rail structure 200 is damaged or broken by the repetitive sliding opening/closing operations of the window/door, the rails 206 may be very simply replaced with new ones by easily separating the rail structure 200 from the substructure 100. That is, the maintenance/repair is very simply done.

That is, since both ends of the detachable rail structure 200 in the flat shaped structure according to the second embodiment of the present invention are held at the rail holding parts 104 of the substructure 100, without any additionally joint means, the detachable rail structure 200 is simply and easily brought out and separated and thus making it very simple to replace and/or maintain/repair the damaged rail structure 200.

In the same manner, the shielding plate 102 positioned at the bottom of the substructure 100 primarily blocks any draft and/or noise, and a portion where the rail holding parts 104 of the substructure 100 and the detachable rail structure 200 are secured secondarily, increasing the efficiency of blocking any draft and/or noise.

INDUSTRIAL APPLICABILITY

In accordance with the present invention, when the window/door is installed, the rail structure with a rail is detachably installed. Therefore, when a defect happens in the rail of the rail structure after the window/door is installed or when the rail of the rail structure is damaged by the operation of repetitive sliding to open/close the window/door, it is very easy to replace the rail with a new rail and/or to maintain/repair it by the separate rail structure.

Further, the rails of the rail structure of the window/door frame are covered so as not to be visible to the outside and the rail covering plate which hides the rails has a flat surface, not only the appearance is neat but also foreign substances are prevented from being trapped, thereby easily maintaining a clean appearance.

Furthermore, the bottom of the substructure installed where the window/door frame is to be installed and the parts of the inside wall of the substructure where the rail structure is held are formed in multi-levels, making it possible to easily block any drift and/or noise.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A window or door system having a hidden rail structure comprising:

a substructure (100) to be open at a top and installed in a two or more parallel line arrangement where a window/door frame is to be installed, comprising: a shielding plate (102) installed at a bottom side of the substructure (100), and rail holding parts (104) formed in a single body with two inside walls of the substructure (100), above the shielding plate (102) in a direction of the length of the substructure (100);

a rail structure (200) to be detachably secured on the rail holding parts (104) of the substructure (100);

a rail covering structure (300) having a flat shaped structure, to prevent the detachable rail structure (200) from being exposed or visible to the outside, comprising connection parts (302) formed in a single body with an under side of the rail covering structure (300), so that the connection parts (302) are connected within a connection element (202) of the detachable rail structure (200); and a window/door driving structure (500) comprising: a top plate (502) to be connected with a chassis frame (110) of a window/door by a fastening structure (400), an inside plate (504) and an outside plate (506) downwardly extending from the inside and outside ends of the top plate (502), respectively, an inside roller supporting plate (508) and an outside roller supporting plate (510) respectively inwardly and outwardly extending from the lower ends of the inside plate (504) and outside plate (506), and rollers (512) positioned at bottoms of the inside and outside roller supporting plates (508, 510) and secured to roll along rails (206) of the rail structure (200), wherein the detachable rail structure (200) comprises: securing parts (204) formed in a single body with the inside and outside ends of the rail structure (200), so that the securing parts (204) are secured to the rail holding parts (104) of the substructure (100), wherein the connection element (202) protrudes at a central part of the rail structure (200), so that the connection parts (302) of the rail covering structure (300) are inserted in the connection element (202), and wherein the rails (206) are respectively positioned between one of the securing parts (204) and the connection element (202) and between the other of the securing parts (204) and the connection element (202).

2. The window or door system having a hidden rail structure according to claim 1, wherein the fastening structure (400) to connect and fasten the chassis frame (110) of the window/door and the window/door driving structure (500) comprises: a horizontal assembling plate (402) to be assembled at a bottom of the chassis frame (110) of the window/door; and a vertical fastening plate (404) formed in a single body on an under surface of the horizontal assembling plate (402), to be inserted into an opening (514) formed on the top plate (502) of the window/door driving structure (500).

3. A window or door system having a hidden rail structure comprising:

a substructure (100) to be open at a top and installed in a two or more parallel line arrangement where a window/door frame is to be installed, comprising: a shielding plate (102) installed at a bottom side of the substructure (100), and rail holding parts (104) formed in a single body with two inside walls of the substructure (100), above the shielding plate (102) in a direction of the length of the substructure (100);

a rail structure (200) to be detachably secured on the rail holding parts (104) of the substructure (100);

a rail covering structure (300) to prevent the detachable rail structure (200) from being exposed or visible to the outside, comprising: a horizontal plate (304) having a sliding hole (306) being lengthwise cut and formed at a central part of the horizontal plate (304);

and a vertical plate (308) formed in a single body at the inside and outside ends of the horizontal plate (304), to be secured to the detachable rail structure (200); and a window/door driving structure (500) comprising: a top plate (502) to be connected with a chassis frame (110) of a window/door by a fastening structure (400), an inside plate (504) and an outside plate (506) downwardly extending from the inside and outside ends of the top plate (502), respectively, a bottom plate (520) formed in a single body with the lower ends of the inside plate (504) and outside plate (506), a roller supporting rod (516) in a straight line shape formed in a single body at a central position on an under surface of the bottom plate (520), and rollers (512) mounted under a roller supporting plate (518) formed in a single body at a lower end of the roller supporting rod (516), so that the rollers (512) are secured to roll along the rails (206) of the detachable rail structure (200), wherein the detachable rail structure (200) has a flat shaped structure and comprises securing projections (208) protruding on the inside and outside ends of the rail structure (200), to secure the rail covering structure (300), and wherein the rail covering structure (300) comprises securing supporting parts (310) formed in a single body at both lower ends of the vertical plate (308), to be secured at the securing projections (208) of the detachable rail structure (200).

4. The window or door system having a hidden rail structure according to claim 3, wherein the rail covering structure (300) comprises airtight packing units (312) positioned on the rail covering structure (300) and secured to an outside surface of the roller supporting rod (516).

5. The window or door system having a hidden rail structure according to claim 3, wherein the fastening structure (400) connecting and fastening the chassis frame (110) of the window/door and the top plate (502) of the window/door driving structure (500) comprises: press-fitting elements (430) to be press-fit into the top plate (502) of the window/door driving structure (500), and binding ends (120) formed in a single body at under surfaces of the chassis frame (110), to be partially inserted into tops of the press-fitting elements (430).

* * * * *